US011457725B2

(12) United States Patent
Varch et al.

(10) Patent No.: US 11,457,725 B2
(45) Date of Patent: Oct. 4, 2022

(54) STAMPED BRUSH HEADS AND BRUSH HEAD STAMPING MANUFACTURING METHODS

(71) Applicant: KONINKLIJKE PHILIPS N.V., Eindhoven (NL)

(72) Inventors: Martin Varch, St. Margareten (AT); Michael Meidl, Seeboden (AT); Florian Kopeinig, Klagenfurt (AT)

( * ) Notice: Subject to any disclaimer, the term of this patent is extended or adjusted under 35 U.S.C. 154(b) by 37 days.

(21) Appl. No.: 16/629,329

(22) PCT Filed: Jun. 20, 2018

(86) PCT No.: PCT/EP2018/066343

§ 371 (c)(1),
(2) Date: Jan. 8, 2020

(87) PCT Pub. No.: WO2019/011600

PCT Pub. Date: Jan. 17, 2019

(65) Prior Publication Data

US 2021/0137257 A1 May 13, 2021

Related U.S. Application Data

(60) Provisional application No. 62/576,134, filed on Oct. 24, 2017, provisional application No. 62/531,390, filed on Jul. 12, 2017.

(51) Int. Cl.
*A46D 3/04* (2006.01)
*A46B 3/06* (2006.01)
(Continued)

(52) U.S. Cl.
CPC ..... *A46D 3/045* (2013.01); *A46B 3/06* (2013.01); *A46D 3/005* (2013.01); *A46D 3/08* (2013.01);
(Continued)

(58) Field of Classification Search
CPC .... A46B 3/00; A46B 1/00; A46B 3/06; A46D 3/045; A46D 3/00; A46D 3/02; A46D 3/005; A46D 9/02
(Continued)

(56) References Cited

U.S. PATENT DOCUMENTS 5,970,564 A 10/1999 Inns
6,045,649 A 4/2000 Weihrauch
(Continued)

FOREIGN PATENT DOCUMENTS

CN 2096269 U 2/1992
DE 19606416 A1 8/1997
(Continued)

OTHER PUBLICATIONS

International Search Report and Written Opinion, International Application No. PCT/EP2018/066343, dated Dec. 17, 2018.

*Primary Examiner* — Laura C Guidotti

(57) ABSTRACT

A brush head (10) and a method (200) for manufacturing a brush head. The method (200) includes stamping (220) a plurality of openings (62) into a strip or roll of backing material (60). A bristle tuft (21) is inserted into each of the openings in the backing material. A proximal end (23) of each bristle tuft is bonded to a proximal side (63) of the backing material to create a merged proximal end head portion (26). Excess portions of the backing material are removed to form a plurality of carrier elements (24) about the openings from the backing material. The carrier elements form a plurality of merged tuft assemblies (20). A platen (42) of a neck (40) is positioned in relation to the merged tuft assemblies. A matrix material (30) is injected around the platen and the merged tuft assemblies to at least partially encompass the platen and the carrier elements of the merged tuft assemblies.

10 Claims, 5 Drawing Sheets

(51) Int. Cl.

| | |
|---|---|
| ***A46D 3/08*** | (2006.01) |
| ***A46D 3/00*** | (2006.01) |
| ***A46D 9/02*** | (2006.01) |
| *A46B 9/04* | (2006.01) |

(52) U.S. Cl.
CPC ..... *A46D 9/02* (2013.01); *A46B 9/04* (2013.01); *A46B 2200/1066* (2013.01); *A46D 3/00* (2013.01); *A46D 3/04* (2013.01)

(58) Field of Classification Search
USPC ..... 300/10, 21
See application file for complete search history.

(56) References Cited

U.S. PATENT DOCUMENTS

| | | | |
|---|---|---|---|
| 7,275,277 | B2 | 10/2007 | Moskovich et al. |
| 8,069,524 | B2 | 12/2011 | Kraemer |
| 8,845,034 | B2 | 9/2014 | Birk et al. |
| 2009/0013488 | A1 | 1/2009 | Sakurai |
| 2010/0043165 | A1* | 2/2010 | Juentgen ..... B29C 45/14385 15/167.1 |
| 2011/0041273 | A1 | 2/2011 | Boucherie |
| 2013/0291320 | A1 | 11/2013 | Kirchhofer |
| 2014/0137355 | A1 | 5/2014 | Lee |
| 2015/0026905 | A1 | 1/2015 | Jensen |
| 2017/0119141 | A1 | 5/2017 | Kumpf |

FOREIGN PATENT DOCUMENTS

| | | | |
|---|---|---|---|
| DE | 10221786 | A1 | 11/2003 |
| DE | 20301634 | U1 | 6/2004 |
| DE | 202012002332 | U1 | 5/2012 |
| EP | 1603429 | B1 | 8/2007 |
| JP | 6245821 | A | 9/1994 |
| JP | 2017118928 | A | 7/2017 |
| WO | 2016181291 | A1 | 11/2016 |
| WO | 2017009353 | A1 | 1/2017 |

* cited by examiner

STAMPED BRUSH HEADS AND BRUSH HEAD STAMPING MANUFACTURING METHODS

This application is the U.S. National Phase application under 35 U.S.C. § 371 of International Application No. PCT/EP2018/066343, filed on 20 Jun. 2018, which claims the benefit of U.S. Provisional Application No. 62/531,390, filed 12 Jul. 2017 and U.S. Provisional Application No. 62/576,134, filed 24 Oct. 2017. These applications are hereby incorporated by reference herein.

FIELD OF THE INVENTION

The present disclosure is directed generally to methods for manufacturing a brush head assembly with anchor-free bristle tufts over molded with an elastomeric matrix.

BACKGROUND

The brush heads of both manual and power toothbrushes comprise bristles which are used to clean the teeth, tongue, and cheeks. In some toothbrushes, the bristles are stapled, or anchored, into the neck portion of the brush head. In other toothbrushes, the bristles are secured to the head without staples, in methods commonly known as "anchor free tufting".

There are several ways to manufacture brush heads having anchor-free tufting (AFT). In one method, groups, or tufts, of individual bristles are melted or fused together at one end, and then the bristle tufts are over molded with a material that then hardens, forming a brush head. In one method, a pre-molded carrier is used to hold tufts of bristles in place, then the bristle tufts are melted or fused together at one end, and then the carrier and melted ends of bristle tufts are over molded with the brush neck. In yet other methods, bristle tufts that are fused at one end are inserted into holes in the brush neck, and either the neck material is heated to shrink around the bristle tufts, or the brush neck with the inserted bristle tufts are overmolded by another material. However, there are limitations and difficulties with each of these current manufacturing methods such that the manufacturing methods are slow, involve multiple steps and equipment, or have higher than acceptable failure rates, resulting in loose bristles or bristle tufts which can come out of the brush head during use.

Accordingly, there is a need in the art for methods and apparatus for more efficiently manufacturing brush heads with anchor free tufting.

SUMMARY OF THE INVENTION

The present disclosure is directed to inventive methods for manufacturing a brush head with secured bristle tufts. Various embodiments and implementations herein are directed to manufacturing methods in which a strip or roll of backing material is stamped with openings there through. Optionally, the backing material can be further stamped and separated into individual carrier elements, carrier plates having a plurality of carrier elements, and/or a tuft carrier web having a plurality of the carrier elements interconnected by webs or strands of material.

After forming the carrier elements (e.g., either individually, or arranged as part of a carrier plate or carrier web), the carrier elements can be processed further, including insertion of bristle tufts into the openings, bonding the bristles and carrier elements together, and/or over molding with a matrix material. Each subsequent step may occur immediately following the previous step, or at a later time. This enables different steps or stages of the manufacturing process to occur at different times or manufacturing locations.

Once the bristle tufts have been inserted into the openings in the backing material (or carrier element if already formed from the backing material), optionally, either or both ends of the bristle tufts can be trimmed or adjusted to achieve a desired contour for what will become the brushing surface of the brush head, and/or to achieve a uniform length of the proximal end of the bristle tufts.

The bristle tufts proximal ends, or, in some arrangements, the bristle tuft proximal ends and at least a portion of the proximal side of the backing material (or carrier element if already formed from the backing material), are merged together by means of a bonding process such as melting, chemical adhesion, or laser fusing to form a merged proximal end head portion. For example, bonding may include a melting process, using for example, a laser or heat source by which the bristle strands and at least a portion of a carrier element are secured together such that merged tuft assemblies are formed. Optionally, after cooling or solidifying from the bonding process, if not done previously, the carrier elements (with merged bristles due to the bonding) can be stamped or cut out into individual merged tuft assemblies or a plurality of merged tuft assemblies connected via a carrier plate or carrier web as described above. Once the merged tuft assemblies are stamped out (e.g., individually, or as part of a connected carrier plate or carrier web), the platen portion of the brush head neck and the merged tuft assemblies can be overmolded with a matrix material, such as an elastomeric material, resulting in a completed brush head. The various embodiments and implementations herein provide a cost-effective and efficient production of brush heads with bristle tufts secured in a carrier element formed at least in part by stamping from a roll or strip of material, which is substantially improved.

Generally, according to one aspect, a method for manufacturing a brush head is provided. The method includes the steps of stamping a plurality of openings into a backing material; inserting a bristle tuft into each of the openings in the backing material; bonding a proximal end of each bristle tuft to a proximal side of the backing material to create a merged proximal end head portion; removing excess portions of the backing material to form a plurality of carrier elements about the openings from the backing material, the carrier elements forming a plurality of merged tuft assemblies that comprise the proximal end head portions when bonded to the bristle tufts; positioning a platen of a neck in relation to the merged tuft assemblies; and injecting a matrix material around the platen and the merged tuft assemblies such that the matrix material at least partially encompasses the platen and the carrier elements of the merged tuft assemblies.

In one embodiment, the method further includes providing the backing material from a roll, a strip, or a combination including at least one of the foregoing. In one embodiment, the plurality of openings (62) cut or stamped into the backing material can be of differing shapes, sizes, or both.

In one embodiment, the step of bonding includes applying heat to melt the bristle tufts and the backing material, or carrier elements if already formed from the backing material, together. In one embodiment, the bristle tufts and the backing material are made of a same or similar material having the same or a similar melting point. In other arrangements, the step of bonding can be by any suitable process such as welding (ultrasonic, laser, etc.), melting, adhesives, chemical fusion, etc.

In one embodiment, the method further includes adjusting the proximal end of the bristle tufts, a free end of the bristle tufts opposite to the proximal end, or both. In one embodiment, the removing occurs before the bonding. In one embodiment, the removing occurs after the bonding. In one embodiment, the removing includes forming a tuft carrier web or a tuft carrier plate that comprises the plurality of carrier elements interconnected together.

In one embodiment, the tuft carrier web comprises the plurality of merged tuft assemblies interconnected together after the carrier elements are bonded to the bristle tufts.

Generally, in another aspect, a brush head assembly is provided. The brush head assembly includes a plurality of merged tuft assemblies, each including a bristle tuft comprising a plurality of bristle strands and having a free end and a proximal end; a carrier element having an opening therethough configured to receive the bristle tuft; and a merged proximal end head portion formed by bonding the proximal end of the bristle tufts to the carrier element; wherein the carrier elements for each of the plurality of merged tuft assemblies were stamped from a strip of backing material; a neck having a platen; and a matrix material at least partially encompassing the platen and the carrier elements of the merged tuft assemblies.

In one embodiment, the backing material and bristle tufts are composed of the same or similar material. In one embodiment, the merged proximal end head portion is formed by the bristle tufts melted together with the carrier elements. In one embodiment, wherein the plurality of merged tuft assemblies are interconnected in a tuft carrier web or a tuft carrier plate. In one embodiment, the matrix material is an elastomeric material.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method for manufacturing a brush head assembly with bristle tufts retained by anchor free tufting in a carrier element stamped from a roll or strip of material, which are then, along with a portion of a neck of the brush head, merged within a matrix material, such as an elastomeric material. More generally, applicants have recognized and appreciated that it would be efficient to stamp openings into a strip or a roll of a backing material, insert bristle tufts into the openings, and bond the proximal end of the bristle tufts with at least a portion of the backing material to form a merged proximal end head portion. After removing excess material and bonding the bristle tuft to the backing material (or carrier element), a merged tuft assembly is formed. The merged tuft assemblies can be molded together with a neck and matrix material to form a brush head. By forming and cutting carrier elements out of a common strip or roll of backing material, it provides the ability to efficiently and cost-effectively manufacture brush heads.

Figure 1:
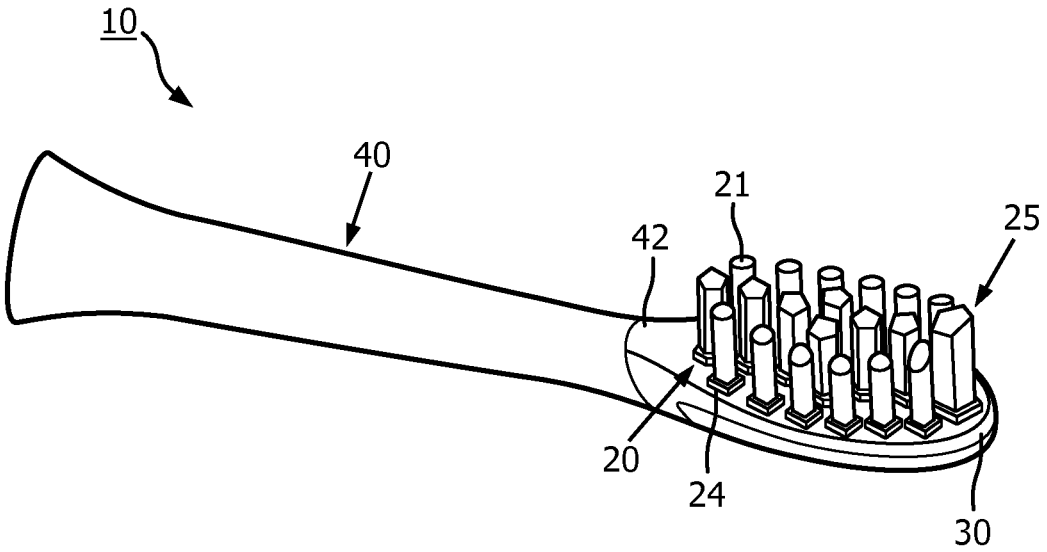
FIG. 1 is a perspective side view of a brush head assembly in accordance with an embodiment.

Referring to FIG. 1, in one embodiment, a schematic representation of a brush head assembly 10 is provided. More particularly, the brush head assembly 10 may include, but is not limited to, a plurality of merged tuft assemblies 20 at least partially disposed within a matrix material 30 at a distal end of a neck 40, which may be referred to as a platen 42. The platen 42 may be, or include, a generally flat portion that provides a hard, rigid, or otherwise reinforcing substrate that is aligned with the bristles of the merged tuft assemblies 20 to support the bristles of the brush head assembly 10 during use. The neck 40 can be coupled to, or form a part of, any manual or powered toothbrush shaft. For example, the neck 40 may be configured to be removably coupled to an actuator or drive shaft (not shown) of a powered oral care device (e.g., electronic toothbrush) now known or to be developed.

Figure 2:
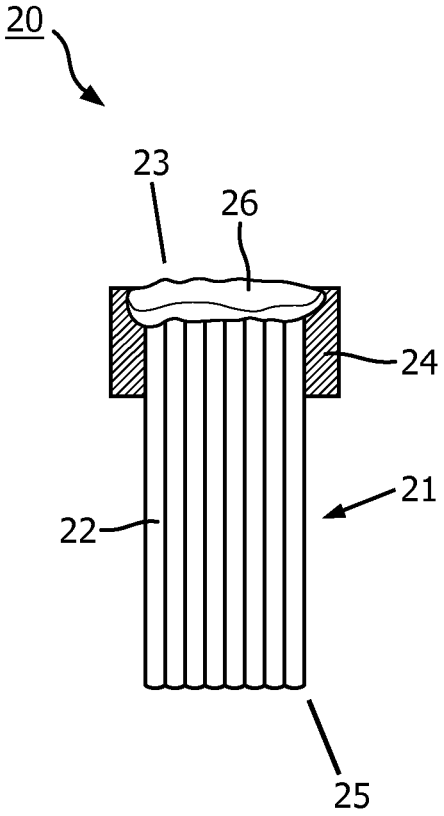
FIG. 2 is a cross-sectional side view of a merged tuft assembly 20 according to one embodiment disclosed herein.

As shown in cross-section in FIG. 2, each of the merged tuft assemblies 20 includes a bristle tuft 21. Each of the bristle tufts 21 comprises a plurality of individual bristle filaments or strands 22. Each bristle tuft 21 has a proximal end 23, which is secured at, with, or to a carrier element 24 and a free end 25 opposite the proximal end 23. The free end forms the brushing surface used to clean the surface of teeth in the completed brush head assembly 10. As discussed in more detail below, the bristle tufts 21 are arranged in openings in carrier elements 24. The strands 22 can be arranged in the tufts 21 in any shape defined by the openings of the carrier elements 24, such as a circular, triangular, square, pentagonal, hexagonal, heptagonal, octagonal, nonagonal, decagonal or other shape.

The bristle strands 22 may be made from a material such as plastics, in particular ABS (Acrylonitrile Butadiene Styrene), nylons such as PA (polyamide) nylon, a thermoplastic polymer such as polypropylene, or a similar material, or variations or combinations of these materials. The carrier element 24 and the bristle strands 22 may be made from the same or compatible materials to achieve sufficient bonding to form a closed sealed unit, e.g., during a bonding processes such as welding, fusing, chemical interaction, melting, etc.

For example, the material of the bristle strands 22 and in some arrangements, the carrier elements 24, may be selected such that they will melt and fuse together at a specific melting co-efficient. However, dissimilar materials can be used if sufficient bonding between the materials can be achieved in another manner, such as via adhesives or chemical interaction. For example, where the bristle strands 22 and the carrier elements 24 selected are of dissimilar materials that will not or not sufficiently melt or fuse together, the strands 22 may be secured with or to the respective carrier element 24 by using an adhesive or other material or a process other than melting or fusing via heat. To illustrate, the bristle strands 22 may be bonded together via, an adhesive or other material, or one or more processes (other than heat) may be applied to bond the carrier element 24 and the bristle strands 22. As another illustration, the bristle strands 22 and carrier element 24 may be bonded altogether via adhesive or other material or one or more other processes (other than heat) that secures the element 24 and the strands 22.

The proximal ends 23 of the bristle tufts 21 (and at least a portion of the carrier elements 24 if made from compatible materials) are bonded to produce a merged proximal end head portion 26 that secures the bristle tufts 21 in the openings through the carrier elements 24, thereby forming the merged tuft assembly 20. At least a portion of the merged proximal end head portion 26 of the merged tuft assembly 20 and a portion of the neck 40 (e.g., the platen 42) may be molded together within the matrix material 30 to form the brush head assembly 10. According to an embodiment, the matrix material 30 is made from one or more varieties of flexible thermoplastic elastomer (TPE) or silicone rubber. The neck 40 may be made from a material with a higher elastic modulus value than the matrix material 30 (e.g., a stiff, resilient plastic).

Figure 3:
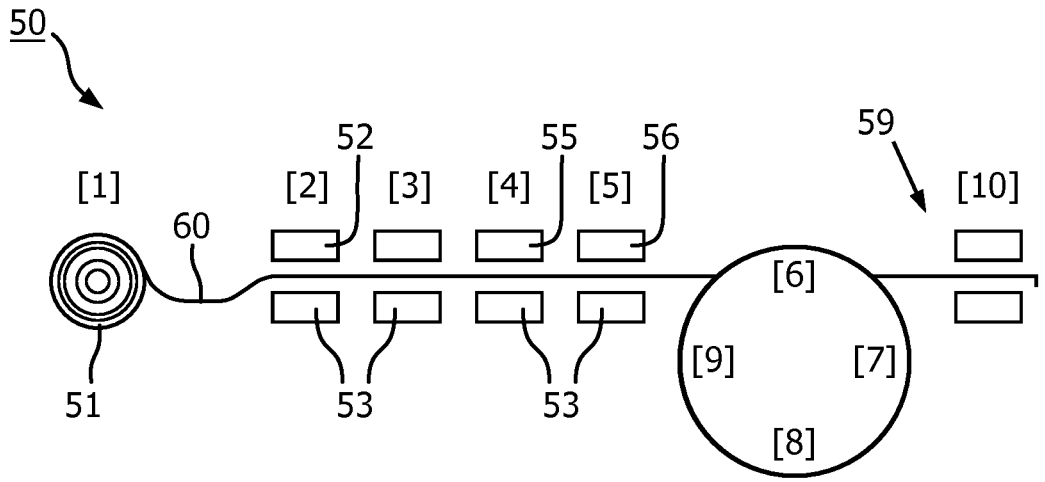
FIG. 3 schematically illustrates a production line for manufacturing a brush head according to one embodiment disclosed herein.

A manufacturing production line 50 for manufacturing brush heads, e.g., the brush head 10, is illustrated in FIG. 3. Various steps or stages employed in the production line 50 may best be understood in FIGS. 4A-4E, which are marked with the corresponding stage number from FIG. 3 in brackets. At stage [1], the production line 50 is provided with a backing material 60 in a blank form. The backing material 60 may be provided from a roll 51, or in some other form such as a strip 51*a* (not shown), plate, etc. As discussed in more detail below, the backing material 60 may have a width and thickness sufficient from which to produce the carrier elements 24. The backing material 60 may be formed as a length of material such that carrier elements 24 for a number of brush heads may be successively produced from the same piece of backing material, e.g., as the backing material 60 is unspooled from the roll 51 or a strip 51*a* is fed to the manufacturing equipment. In some arrangements, the backing material 60 may have one or more guide holes 61, as shown in FIGS. 4A-4D, to assist in transitioning the backing material 60 between the different pieces of manufacturing equipment in the production line, and/or to keep the backing material 60 at the proper position and tension on the manufacturing equipment, e.g., by engaging the holes 61 with corresponding pins on the manufacturing equipment.

Figure 4A:
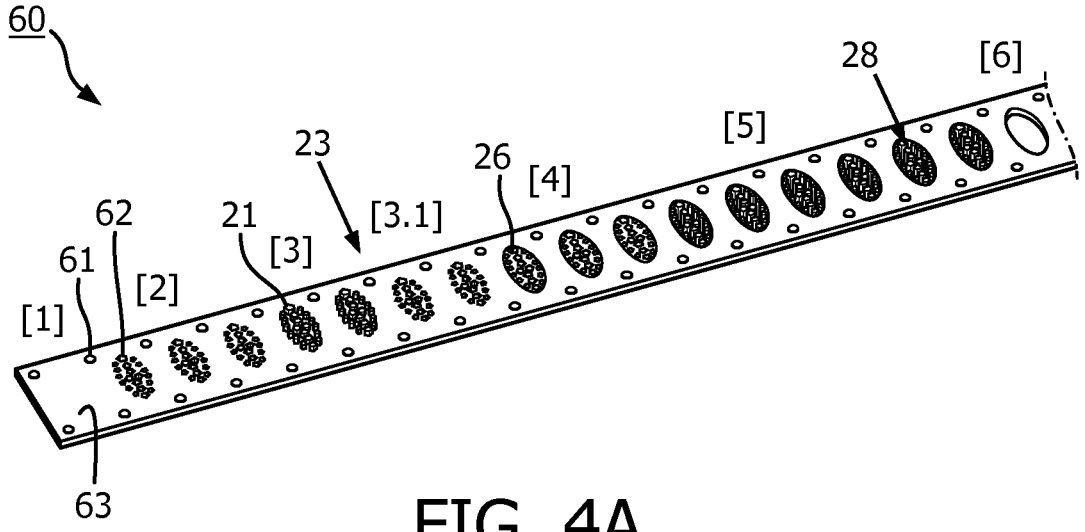
FIGS. 4A-4F illustrate a strip of backing material and resultant components at various manufacturing stages according to embodiments disclosed herein.
Figure 4B:
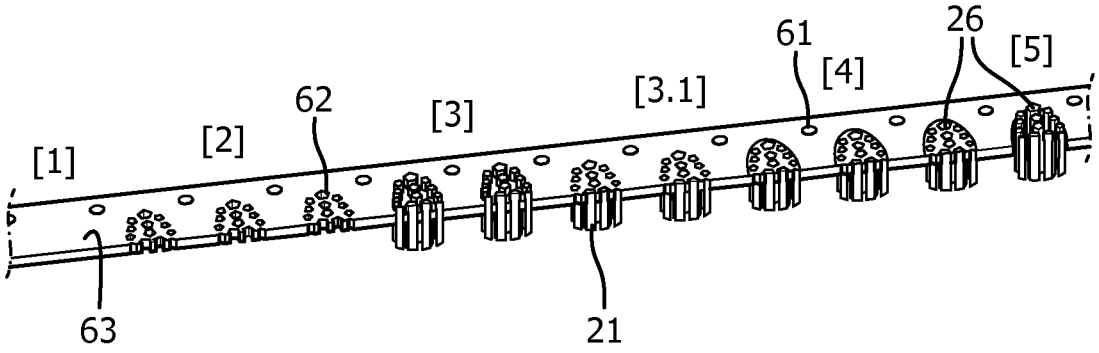
Figure 4C:
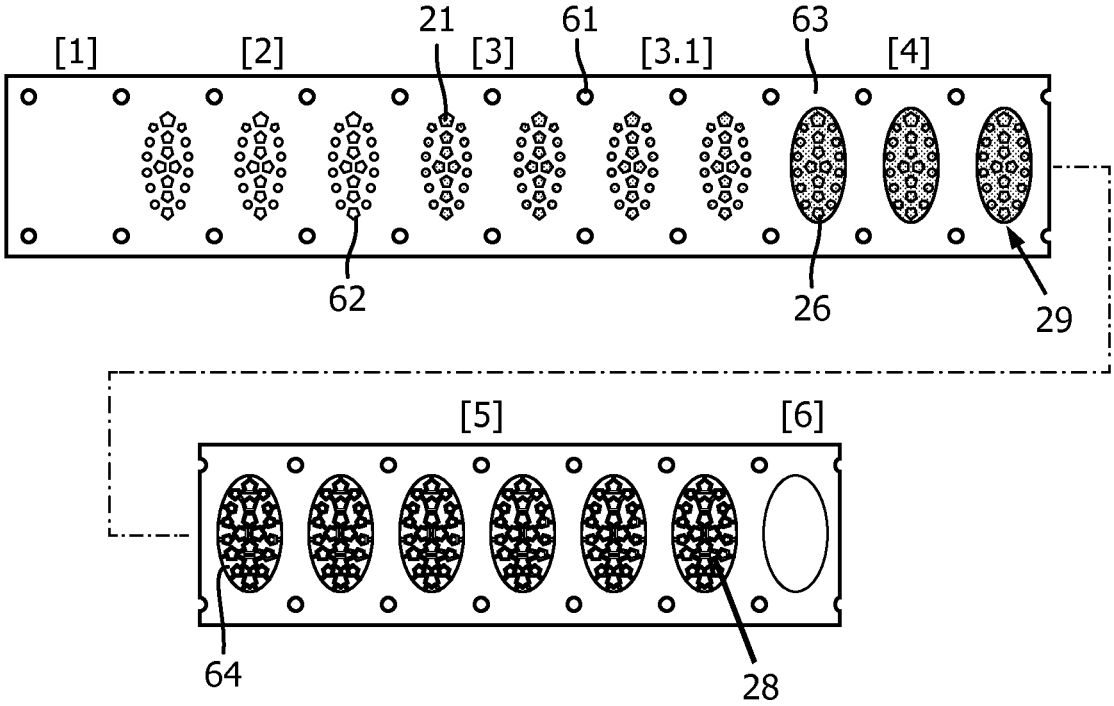

At stage [2], a plurality of openings 62 is stamped through the backing material 60. As can be seen in FIGS. 4A-4C, different sizes, shapes and placements of openings 62 can be stamped into the backing material 60. In this way, the openings 62 may each, and/or together, be arranged in sizes, shapes, and/or patterns to reflect the planned arrangement of bristles tufts 21 in the brush head assembly 10 when completed. As will be better appreciated in view of the below disclosure, the carrier elements 24 are formed from the backing material 60 and the openings 62 form the openings through the carrier elements 24 into which the bristle tufts 21 are inserted and secured. Stage [2] may be carried out using a die and/or stamping equipment 52, or other appropriate means of inserting openings 62 in the backing material 60. If different final bristle configurations are desired, different stamp dies can be used for the various configurations.

During stamping, the backing material 60 and/or portions thereof may be engaged in or on a mold or base plate 53. Once the backing material 60 has been stamped, it is ready for further processing, either immediately, or at a later time and/or place. If at a later time and/or place, the stamped backing material 60 can be rolled or stacked, and unrolled again later or fed into equipment for further processing on the same or different manufacturing equipment. The backing material 60 may stay in the base plate 53 during multiple stages, or may be transferred between different base plates 53, e.g., specifically arranged for each stage, as desired.

Figure 5:
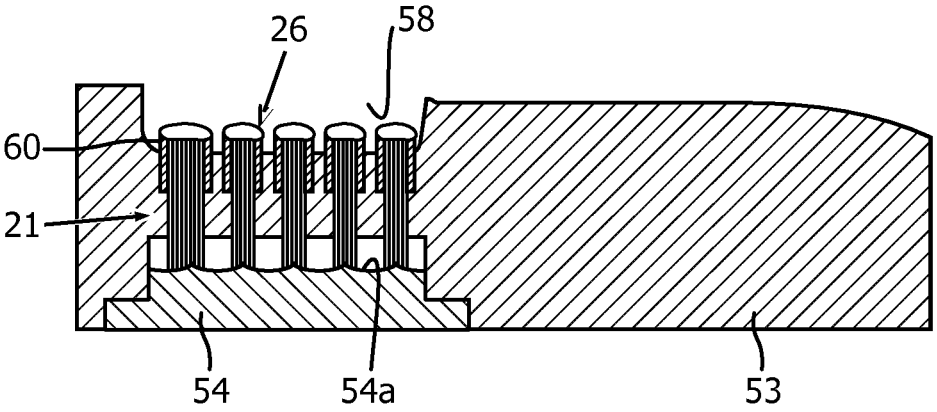
FIG. 5 is a cross-sectional side view showing a free end of bristle tufts being adjusted in a base plate with a contour plate according to one manufacturing stage disclosed herein.

At stage [3], one or more bristle tufts 21 are inserted into the plurality of openings 62 in the backing material 60. As can be appreciated, the bristle tufts 21 must be of the proper size to fit into each respective opening 62 and/or the size and shape of the openings 62 define the respective shape and size of the corresponding bristle tufts 21 when the openings 62 are filled with the bristle strands 22. As shown in FIG. 5, a contour plate 54 may be placed beneath the bristle tufts 21, which has a shape corresponding to the desired contour and/or length for the free ends 25 of the bristle tufts 21 when assembled in the brush head 10. That is, the configuration of the contour plate 54 will help to define the shape or angle of the brushing surface formed by each of the tufts 21, as well as the length of the bristle tufts 21 of the brush head 10 when finished.

For example, the contour plate 54 may be or include a plate or piece of hard material (e.g., metal, plastic, etc.), against which the free end 25 of the bristle tufts 21 will rest so that they are maintained at the proper length during the manufacturing process. In one arrangement, the contour plate 54 may include a contoured surface 54*a*, such as shown in FIG. 5, which surface 54*a* is used to define the shape of what will become the free ends 25 of the bristle tufts 21 in the brush head assembly 10. The contour plate 54 may be or include a removable and interchangeable insert so that different desired shapes for completed brush head bristle free ends can be achieved. A separate contour plate for each bristle tuft may be used if desired (e.g., such as in the form of a plurality of moveable pins, with each pin aligned with a respective one of the bristle tufts 21). In one embodiment, the base plate 53 may include a plurality of partial bores 57 into which the tufts 21 are inserted until they bottom out in order to define the desired shape and/or length for the tufts 21.

In some arrangements of the present invention, the proximal end 23 (and/or free end 25) of the bristle tufts 21 may be trimmed to a desired length. For example, in FIGS. 4A-4B, a portion of the proximal end 23 of the bristle tufts 21 is illustrated as protruding from a proximal side 63 of the backing material 60 at stage [3], and this protruding portion is removed at stage [3.1]. In one embodiment, the protruding portion may be trimmed to a predetermined height, e.g., in order to facilitate later bonding processes, particularly melting or other processes that tend to partially consume the bristle strands 22 during bonding. The cutting or trimming of the bristles 22 may be accomplished by a knife or other cutting tool, e.g., running along the surface of the proximal side 63 of the backing material 60.

At stage [4], the proximal ends 23 of the plurality of bristle tufts 21 are bonded together, which may include bonding the tufts 21 with or to at least a portion of the surrounding backing material 60. For example, sufficient heat to melt the components together may be applied to form the merged proximal end head portion 26 as discussed above with respect to FIG. 2. Thus, it is to be appreciated that the merged proximal end head portion 26 may be formed as a combination of one or more of at least a portion of the side 63 of the backing material 60 and at least a portion of the proximal end 23 of the bristle tufts 21 merged together. Melting or fusing can be achieved by means of a heat source 55, such as a heated press, ram, plate, or pin, which comes into direct physical contact with the proximal end 23 of the bristle tufts 21 and/or the proximal side 63 of the backing material 60. Alternatively, the melting or fusing can be achieved using heated air, a welding laser, chemical fusing, or a variety of other mechanisms that provides sufficient heat to the bristles 22 to undergo bonding, e.g., via radiation, convention, conduction, etc. As noted above, in order to form a merged tuft assembly 20, the backing material 60 and bristle tufts 21 may be made of material having the same or a similar composition, such as ABS, nylon, polypropylene, or variations or combinations of these materials.

Figure 4D:
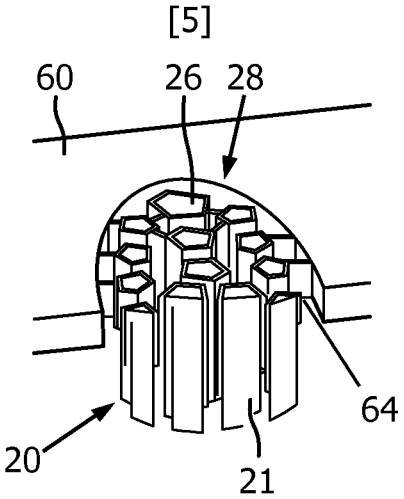
Figure 4E:
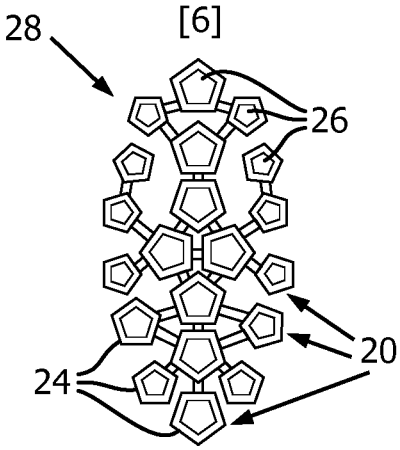
Figure 4F:
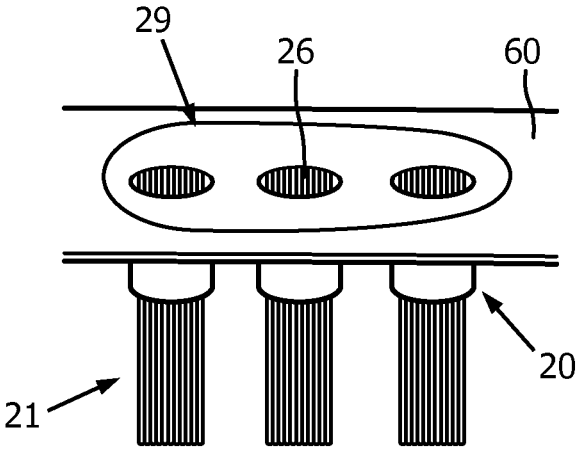

At stage [5], once the merged proximal end head portion 26 is formed (and has cooled or cured sufficiently), in one arrangement of the present invention, excess portions 64 of the backing material 60 may be removed, e.g., by stamping or cutting equipment 56 to form individualmerged tuft assemblies 20, such as shown in FIG. 2. As best illustrated in FIGS. 4C-4E, in one arrangement of the present invention, instead of separate or discrete tuft assemblies 20, a tuft carrier web 28 may be formed as a group of the tuft carrier elements 24 interconnected by strands or webs (e.g., in the final bristle tuft pattern for the brush head 10). Enlarged versions of the tuft carrier web 28 at stage [5] is illustrated in FIGS. 4D and 4E. Stage [5] may include a pre-cutting operation in which the tuft carrier elements 24 and/or the tuft carrier web 28 is still attached to the backing material 60 via one or more strands or webs, as best seen in FIG. 4D. In one embodiment of the present invention, stage [5] of manufacturing is not utilized. In this embodiment, instead of forming the tuft carrier web 28 by removing the excess portions 64, a carrier plate 29 of merged tuft assemblies is created, as best shown in FIG. 4C at stage [4] and FIG. 4F. In this embodiment, manufacturing proceeds from stage [4] directly to stage [6], and the carrier plate 29 of merged tuft assemblies is removed from the backing material, 60 as described below.

At stage [6], individual merged tuft assemblies 20, and/or tuft carrier webs 28, of merged tuft assemblies, or carrier plates 29 of merged tuft assemblies may be completely removed from the backing material 60. An enlarged view of a tuft carrier web 28 is shown in FIG. 4E. Once the completed merged tuft assemblies 20 (either separate or interconnected in the tuft carrier web 28 or in a tuft carrier plate 29) are separated from the backing material 60, the surplus backing material can be disposed of or recycled in stage [10], e.g., processed by waste shredding or cutting equipment 59 as known in standard industrial recycling techniques.

Figure 6:
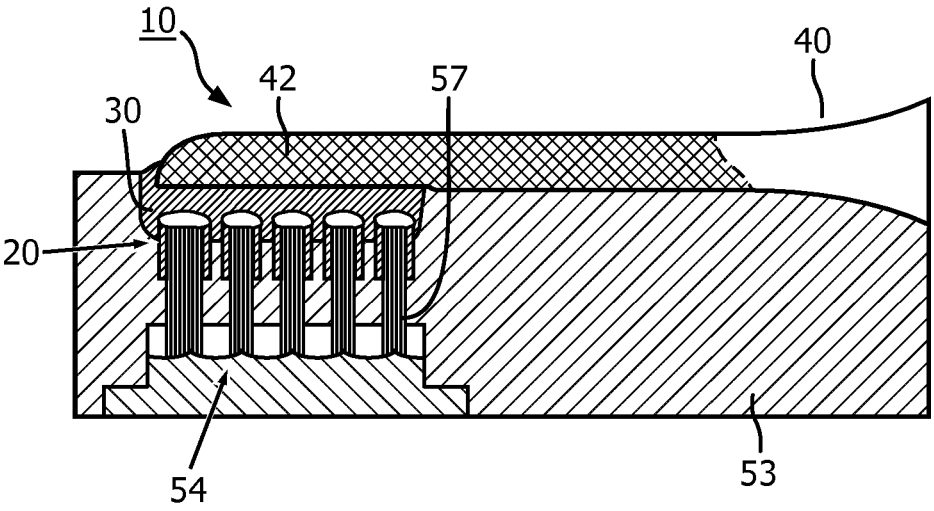
FIG. 6 is a cross-sectional side view showing a matrix material being overmolded onto a neck and a plurality of merged tuft assemblies to form a brush head according to one embodiment disclosed herein.

In stage [7], the neck 40 is formed according to any desired known or future developed standard manufacturing technique, e.g., by molding the neck 40 from plastic. In stage [8], the neck 40 and the merged tuft assemblies 20 (e.g., separately or in the interconnected tuft carrier web 28 or tuft carrier plate 29) are positioned relative to each other and overmolded by the matrix material 30. For example, as shown in FIG. 6, the brush head neck 40 is positioned to put the platen 42 portion of the neck 40 in the proper location in relation to the merged tuft assemblies 20. The merged tuft assemblies 20 may be held in corresponding holes or bores 57 in the base plate 53, while the platen 42 is positioned using a corresponding cavity 58 formed in the base plate 53, as illustrated in FIG. 5, or other positioning mechanism. This creates a space into which the matrix material 30, e.g., an elastomeric material, can be injected as shown in FIG. 6. As a result, the matrix material 30 forms a molded shape that encompasses at least a portion of the platen 42 and the merged tuft assemblies 20 (e.g., the merged proximal end head portions 26), to form the brush head assembly 10. In stage [9], the completed brush head 10 can be ejected from the base plate 53 (not shown).

It is to be appreciated that variations on the above-described manufacturing processes are possible. For example, the above-discussed steps and stages may be optionally performed, performed in a different order, or substituted for other steps or stages. In one embodiment, the backing material 60 is stamped in such a way, e.g., at stage [2], such that the excess portions 64 of the backing material 60 are removed prior to tufting. In this way, the tuft carrier elements 24 and/or the tuft carrier web 28 are tufted and then bonded to the tufted bristles, instead of as described above. In one embodiment, the carrier elements 24, tuft carrier web 28, or carrier plate 29 can be completely cut out of the backing material 60 (e.g., as discussed with respect to stages [5-6]), and further processing (e.g., insertion of bristle tufts in accordance to stage [3], bonding or melting in accordance with stage [4], over molding in accordance with stage [8], etc.), can be completed (e.g., after cutting them out from the backing material 60, the carrier elements 24 tuft carrier web 28 or carrier plate 29 may be maintained in the same base plate 53 until completion of all manufacturing steps). In other embodiments, the partially-processed backing material 60 may be transferred between different baseplates, molds, or pieces of manufacturing equipment at the same or different locations, facilities, and/or times.

Figure 7:
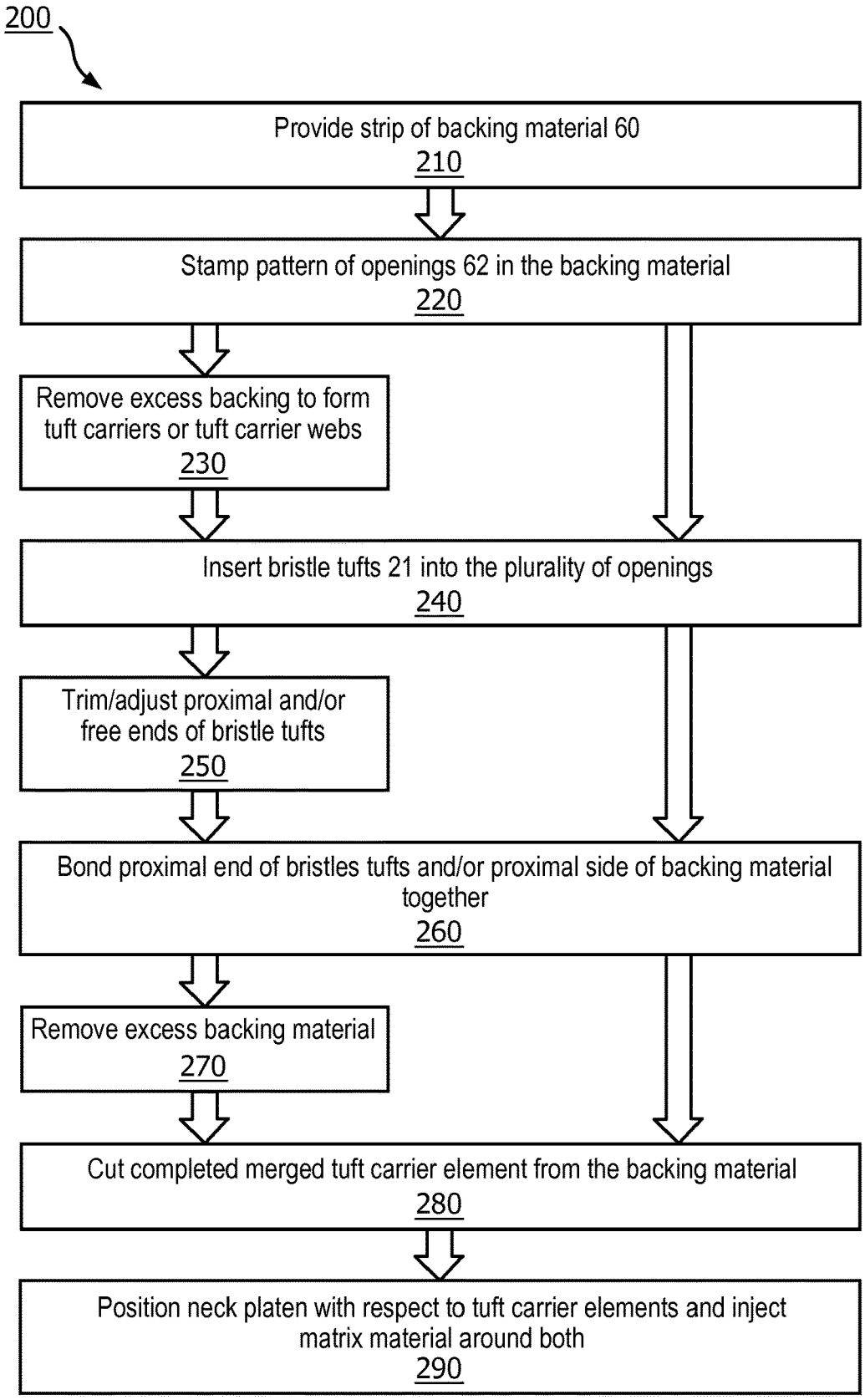
FIG. 7 is a flowchart of a method for manufacturing a brush head assembly in accordance with an embodiment.

Referring to FIG. 7, a method 200 is provided for manufacturing one or more of the various brush head 10 embodiments and implementations described or otherwise envisioned herein. In step 210 of the method 200, a strip 51*a* or roll 50 of backing material 60 is provided (e.g., as described with respect to stage [1] above). In step 220, a plurality of openings 62 is formed through the backing material 60 of a size, shape and pattern to reflect the planned arrangement of bristles in the completed brush head assembly 10 (e.g., as described with respect to stage [2] above).

In one embodiment, optionally, at step 230, the backing material is stamped or cut in such a way that excess portions 64 of the backing material are removed to form one or more separate tuft carrier elements 24 and/or an interconnected web of tuft carrier elements 28. The carrier elements and/or carrier web may be completely cut out of the backing material before subsequent processing. Once the backing material has been stamped or cut to form just the openings or both the openings and the carrier elements and/or carrier web), it is ready for further processing, either immediately, or at a later time and/or place.

At step 240 of the method 200, a bristle tuft 21, comprising a plurality of the bristle strands 22 is inserted into each of the openings formed in step 220. In some embodiments, at step 250 the proximal end 23 and/or the free end 25 of the bristle tufts may be trimmed or adjusted to a set a desired length and/or contouring (e.g., using the base plate 53 and/or the contour plate 54 as discussed with respect to stages [3-3.1] above).

At step 260 of the method 200, the bristle tufts are bonded. For example, the step 260 may include applying heat to the proximal end of the bristle tufts 21 to melt the bristles and/or the backing material together to form a merged proximal end head portion 26. Alternatively, laser welding, adhesives, or other bonding techniques may be used for the bonding step.

Optional step 270 resembles optional step 230 and may be performed if step 230 was not performed previously. That is, at optional step 270, once the merged proximal end head portion of the merged tuft assembly is formed, excess portions of the backing material can be removed to form separate tuft carrier elements 24 and/or an interconnected group of tuft carrier elements arranged in a tuft carrier web 28.

In step 280 of the method 200, the completed tuft carrier elements 24 and/or tuft carrier web 28 or carrier plate 29 can be cut out of the backing material. It is noted that the step 280 may occur directly after, or as part of, the step 230 if desired.

In step 290 of method 200, a platen 42 portion of a brush head neck 40 is positioned in relation to the merged tuft assemblies 20, such as described above. A matrix material 30 can then be injected into the space created between the merged tuft assemblies and the platen portion of the neck. The matrix material, when solidified, encompasses at least a portion of the neck platen and the merged tuft assemblies, to form the completed brush head assembly 10 as shown in FIG. 1.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of"

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a brush head, the method comprising the steps of:

stamping a plurality of openings into a backing material;

inserting at least one bristle tuft into each of the openings in the backing material;

bonding a proximal end of each bristle tuft to at least a portion of proximal side of the backing material to create a merged proximal end head portion that secures the bristle tuft to the backing material to form a merged tuft assembly;

cutting at least one carrier element comprising at least one merged tuft assembly from the backing material;

positioning a platen of a neck in relation to the at least one carrier element of merged tuft assemblies; and injecting a matrix material around the platen and the carrier element of merged tuft assemblies such that the matrix material at least partially encompasses the platen and the carrier elements of the merged tuft assemblies.

2. The method of claim 1, further comprising providing the backing material from a roll, a strip, or a combination including at least one of the foregoing.

3. The method of claim 1, wherein the plurality of openings cut or stamped into the backing material can be of differing shapes, sizes, or both.

4. The method of claim 1, wherein the step of bonding includes applying heat to melt the proximal end of bristle tufts and at least a portion of the proximal side of the backing material together.

5. The method of claim 4, wherein the bristle tufts and the backing material are made of a same or similar material having the same or a similar melting point.

6. The method of claim 1, further comprising a step of adjusting the proximal end of the bristle tufts, a free end of the bristle tufts opposite to the proximal end, or both that occurs before the bonding step.

7. The method of claim 1, further comprising a step of removing at least one excess portion of the backing material that occurs before the bonding step.

8. The method of claim 1, further comprising a step of removing at least one excess portion of the backing material that occurs after the bonding step.

9. The method of claim 1, wherein the removing includes forming a tuft carrier web or a tuft carrier plate that comprises a plurality of carrier elements interconnected together.

10. The method of claim 9, wherein the tuft carrier web or tuft carrier plate comprises the plurality of merged tuft assemblies interconnected together after the merged tuft assemblies are formed.

* * * * *